US009982855B1

(12) United States Patent
Tan

(10) Patent No.: US 9,982,855 B1
(45) Date of Patent: May 29, 2018

(54) BIDIRECTIONAL ROTATING LED DOWNLIGHT

(71) Applicant: Treasure Best Ltd., Dongguan, Guangdong Province (CN)

(72) Inventor: Yiyi Tan, Dongguan (CN)

(73) Assignee: Treasure Best Ltd., Dongguan (CN)

( * ) Notice: Subject to any disclaimer, the term of this patent is extended or adjusted under 35 U.S.C. 154(b) by 0 days. days.

(21) Appl. No.: 15/673,471

(22) Filed: Aug. 10, 2017

(51) Int. Cl.

| | |
|---|---|
| ***F21V 21/26*** | (2006.01) |
| ***F21S 8/02*** | (2006.01) |
| ***F21V 21/28*** | (2006.01) |
| ***F21V 29/77*** | (2015.01) |
| ***F21V 23/02*** | (2006.01) |
| ***F21V 23/00*** | (2015.01) |
| ***F21V 3/04*** | (2018.01) |
| ***F21V 7/04*** | (2006.01) |
| ***F21V 17/12*** | (2006.01) |
| ***F21V 25/12*** | (2006.01) |
| *F21Y 115/10* | (2016.01) |

(52) U.S. Cl.
CPC ..... *F21S 8/026* (2013.01); *F21V 3/0418* (2013.01); *F21V 3/061* (2018.02); *F21V 7/041* (2013.01); *F21V 17/12* (2013.01); *F21V 21/28* (2013.01); *F21V 23/001* (2013.01); *F21V 23/023* (2013.01); *F21V 25/12* (2013.01); *F21V 29/77* (2015.01); *F21Y 2115/10* (2016.08)

(58) Field of Classification Search
CPC ..... F21S 8/026; F21V 21/28; F21V 29/77; F21V 23/023; F21V 23/001; F21V 3/0418; F21V 3/061; F21V 7/041; F21V 17/12; F21V 25/12; F21V 2115/10
See application file for complete search history.

(56) References Cited

U.S. PATENT DOCUMENTS

| | | | | |
|---|---|---|---|---|
| 8,905,583 | B2 * | 12/2014 | Dubord | F21S 2/005 174/653 |
| 2010/0061108 | A1 * | 3/2010 | Zhang | F21V 29/004 362/364 |
| 2012/0147604 | A1 * | 6/2012 | Farmer | H05B 37/0254 362/249.03 |
| 2016/0186962 | A1 * | 6/2016 | Kohn | F21K 9/232 362/284 |
| 2017/0284643 | A1 * | 10/2017 | Coakley | F21V 21/14 |
| 2017/0343190 | A1 * | 11/2017 | Georgiev | F21V 14/06 |

* cited by examiner

*Primary Examiner* — Ali Alavi
(74) *Attorney, Agent, or Firm* — Alan D. Kamrath; Kamrath IP Lawfirm, P.A.

(57) ABSTRACT

A bidirectional rotating LED downlight includes a light source device, a swing frame, a light distribution mechanism, a rotating assembly, a housing assembly and a power supply. The swing frame is installed at the bottom of the light source device; the light distribution mechanism is installed at the bottom of the light source device and inside the swing frame; the rotating assembly is coupled to the swing frame; the housing assembly is disposed inside the rotating assembly and the swing frame and under the light source device and the light distribution mechanism; the power supply is installed at the periphery for supplying power to the light source device through a connecting wire. When use, the rotating assembly is operated for horizontal rotation and the swing frame is operated for vertical swing, so that users may adjust the light projection direction and angle to improve the practicality of its illumination.

11 Claims, 14 Drawing Sheets

BIDIRECTIONAL ROTATING LED DOWNLIGHT

BACKGROUND OF THE INVENTION

Field of the Invention

The present invention relates to a light emitting diode (LED) downlight, and more particularly to a bidirectional rotating LED downlight.

Description of the Related Art

LED downlight is a common and extensively used illuminating lamp. A conventional ED downlight generally comes with a downward illuminating structure and does not have a bidirectional rotating function for a horizontal rotation and a vertical swing, so that the illuminating angle of the conventional LED downlight cannot be adjusted, and users have to change the angle of illumination frequently. Obviously, the conventional LED downlight is inconvenient and requires improvements.

SUMMARY OF THE INVENTION

In view of the aforementioned drawbacks of the prior art, the inventor of the present invention conducted researches and experiments, and finally developed a bidirectional rotating LED downlight in accordance with the present invention to overcome the drawbacks of the prior art.

Therefore, it is a primary objective of the present invention to provide an LED downlight with a bidirectional rotating function capable of performing both horizontal rotation and vertical swing, and facilitating users to select and adjust the light projection direction and angle.

To achieve the above mentioned objective, a bidirectional rotation LED downlight of the present invention comprises a light source device, a swing frame, a light distribution mechanism, a rotating assembly, a housing assembly and a power supply.

The above mentioned light source device further comprises a heat sink, an LED light source, a support frame and a cover, and wherein the heat sink having a plurality of fans arranged radially from the middle of a sold body of the heat sink, and the LED light source is supported by the support frame and coupled to the bottom of the heat sink, and wherein a large through hole formed in the middle of the support frame providing for the LED light source to project an LED light downward, and the cover is coupled to the top of the heat sink.

The above mentioned swing frame has a flat portion and a center hole formed in the middle of the flat portion, and wherein the flat portion coupled to the bottom of the heat sink so that the center hole being aligned precisely with the solid body of the heat sink, and at least two latch slots formed at the bottom of the flat portion and disposed around the center hole, and a small section extending separately and outwardly from both sides of the flat portion and then vertically downward to form a connection plate, and wherein a fixing hole and an adjusting hole formed and penetrated through the connection plate.

The above mentioned light distribution mechanism comprises a fixed cylinder and a light distribution member, and wherein an inwardly hollow containing space formed at both of the top and bottom of the fixed cylinder separately and a shield wall reserved at the periphery of the bottom of the containing space, and at least two buckles disposed and extended outwardly from the outer wall of the top of the fixed cylinder, and wherein the light distribution member contained in the containing space of the fixed cylinder and having a bottom periphery abutting the shield wall, and further the buckles of the fixed cylinder passing through the latch slots of the swing frame respectively for latching.

The above mentioned rotating assembly comprises an upper rotating ring, an upper fixed ring and a lower rotating ring, and wherein the upper rotating ring having a large through hole formed at the middle of the upper rotating ring and the ring body having a connection plate symmetrically erected from both sides of the internal periphery of the connection plate, and wherein the connection plate having a fixing hole and an adjusting arc slot, and the middle of the upper fixed ring is a large through hole, and the ring body is further divided into an outer peripheral wall and an inner peripheral wall, and wherein the inner peripheral wall being taller than the outer peripheral wall, and the lower rotating ring further has a large through hole formed at the middle of the lower rotating ring, and wherein the ring body having three arc stripe slots formed and distributed uniformly on the ring body and the large through hole having a vertical wall extending downwardly and vertically from the internal periphery of the large through hole, and the rotating assembly is operated with a stand mechanism, and wherein the stand mechanism having a board with a large mounting hole formed thereon, and during assembling, the upper rotating ring is installed onto the board of the stand mechanism and the large through hole of the upper rotating ring is aligned precisely with the large mounting hole of the board, and then the inner peripheral wall of the upper fixed ring is coupled and covered onto the upper rotating ring, and wherein the outer peripheral wall of the upper fixed ring being covered onto the board and then an engaging member passing through the outer peripheral wall of the upper fixed ring and coupled to the board, and meanwhile, the lower rotating ring is attached onto the bottom of the board and the large through hole of the lower rotating ring is aligned precisely with the large mounting hole of the board, and then an engaging member is passed through the arc stripe slot of the lower rotating ring, and wherein an engaging member then passing through the arc stripe slot of the lower rotating ring and coupled to the board, and the connection plates on both sides of the swing frame are disposed on the outer side of the connection plate of the upper rotating ring, and wherein an engaging member passing through the fixed hole on the connection plate of the upper rotating ring and pivotally coupled to the fixing hole of the connection plate of the swing frame, and an adjusting screw passing through the adjusting arc slot of the connection plate of the upper rotating ring and locked securely with the adjusting hole of the connection plate of the swing frame.

The above mentioned housing assembly at least comprises a decorative ring, a reflector and an elastic plate, and wherein the decorative ring having a planar circular disc with the middle erected upwardly to form a standing wall and the interior being penetrated to form a large through hole, and a wall bracket is formed at the bottom edge of the outer surface of the reflector and the middle is penetrated to form a light output hole, and wherein the outer surface of the reflector having at least two engaging walls, and the elastic plate with a length is locked onto the engaging wall, and the reflector is accommodated in the large through hole of the decorative ring so that the wall bracket supports the bottom edge of the standing wall of the decorative ring and then the reflector is received from the large through hole of the lower rotating ring, and wherein the vertical wall of the lower rotating ring being inserted into a range of the standing wall of the decorative ring during the process, while both side edges of the elastic plate being bent inwardly to abut the inner wall surface of the vertical wall of the lower rotating ring.

The above mentioned power supply comprises a box body, a connector cover, a thermostat and a connecting wire, and wherein the box body receiving power supplied from the mains to stabilize and rectify a circuit compilation wore, the connector cover is substantially a semicircular arc and latched onto the cover, the thermostat is suspended in the space under the cover, and the connecting wire leads the power source in the box body to the connector cover and connects the thermostat and the LED light source downwardly to achieve an electrical connection.

The light distribution member of the above mentioned bidirectional rotating LED downlight is a lens or a reflective cup.

The reflector of the above mentioned bidirectional rotating LED downlight has a glass plate installed to the top of the reflector and disposed onto the light output hole of the reflector, and a group of locking members are passed through a group of pressing plates and locked to an edge of a sidewall where the engaging wall and the reflector are coupled in order to press the glass plate and the reflector for connection and positioning.

The decorative ring and the reflector of the above mentioned bidirectional rotating LED downlight may be of any shape.

The upper rotating ring of the above mentioned bidirectional rotating LED downlight has at least three outer flanges protruded from the external periphery of a ring body of the upper rotating ring and provided for reducing the friction with the upper fixed ring when the upper rotating ring is rotated.

The upper rotating ring of the above mentioned bidirectional rotating LED downlight has at least three lower flanges protruded downwardly from the bottom edge of a sidewall of the upper rotating ring and provided for reducing the friction with the board when the upper rotating ring is rotated.

The upper rotating ring of the above mentioned bidirectional rotating LED downlight has a positioning bump formed on a sidewall of the upper rotating ring, and the upper fixed ring has a limit bump formed at the internal periphery of an inner peripheral wall of the upper fixed ring, so that when the upper rotating ring is rotated, the positioning bump is limited by the limit bump, and the upper rotating ring can only rotate in one direction and then rotate in the opposite direction.

The upper rotating ring of the above mentioned bidirectional rotating LED downlight has a packing member screwed onto a sidewall of the upper rotating ring and provided for positioning the upper rotating ring by a packing effect.

The reflector of the above mentioned bidirectional rotating LED downlight is a tapered conical object with a conical light output hole formed and vertically penetrating through the reflector.

The light output hole of the above mentioned bidirectional rotating LED downlight further has an oblique side hole formed on a side of the light output hole, in addition to the top portion.

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

Figure 1:
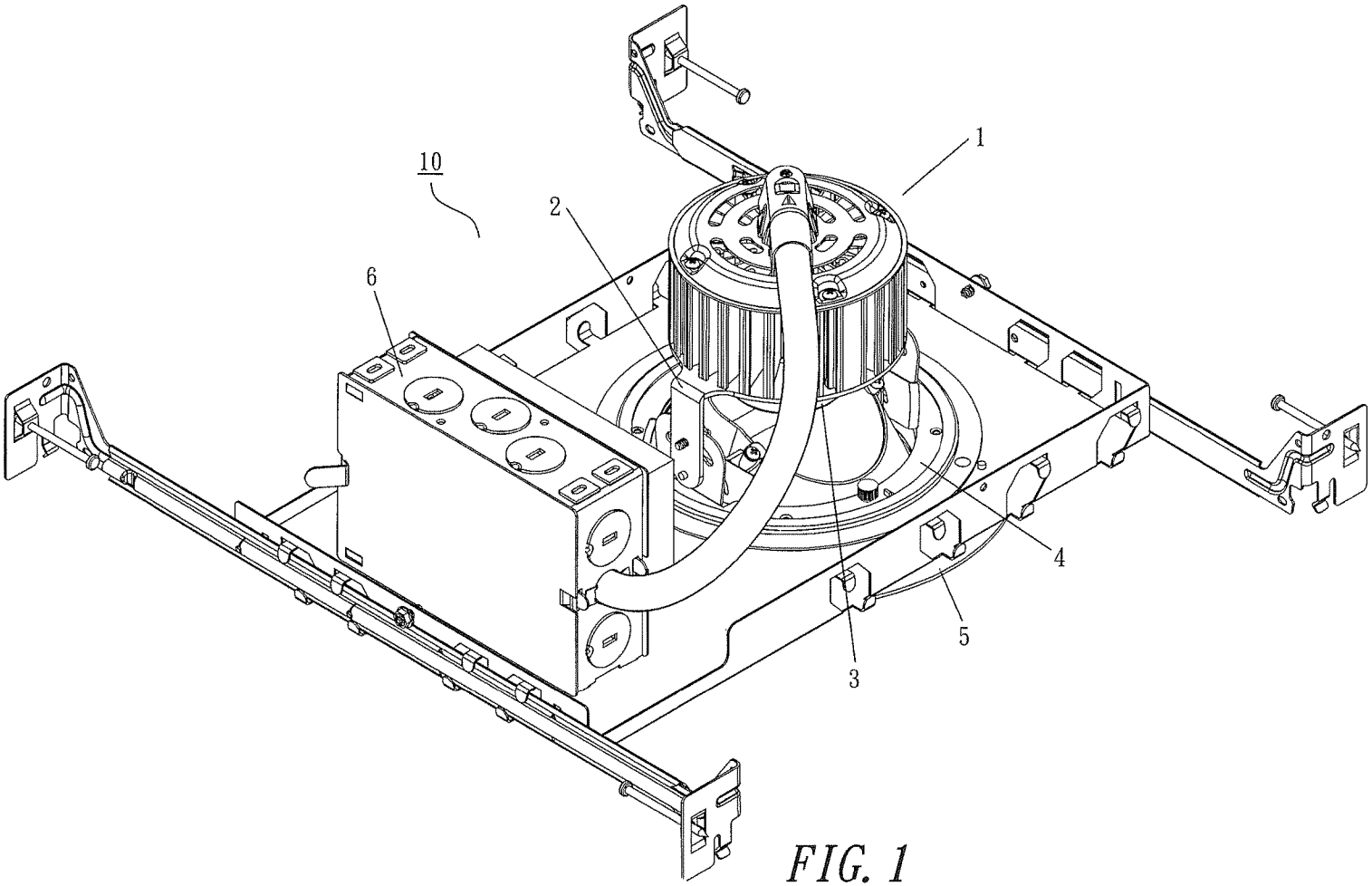
FIG. 1 is a perspective view of an embodiment of the present invention.
Figure 2:
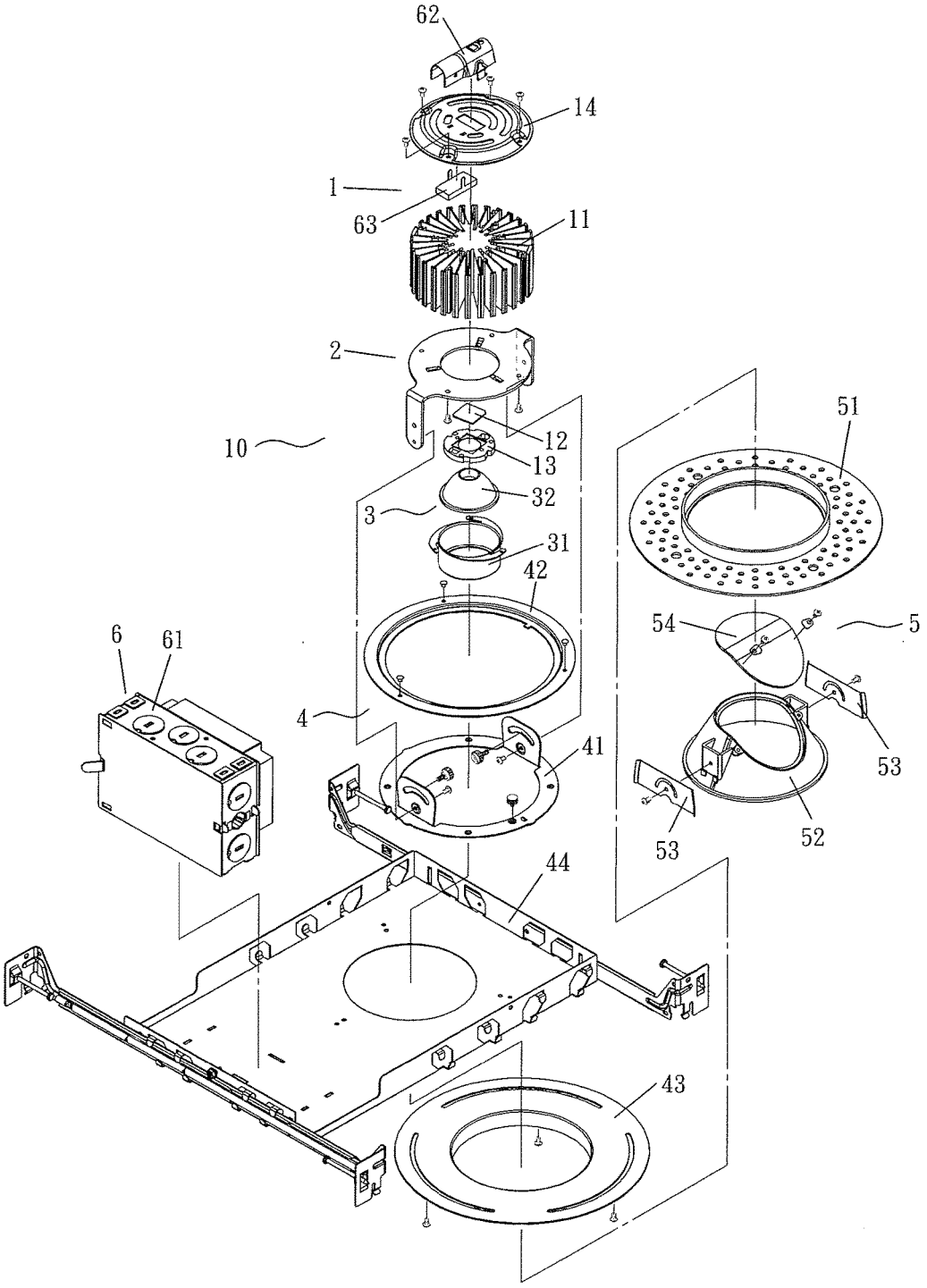
FIG. 2 is an exploded view of an embodiment of the present invention.
Figure 3:
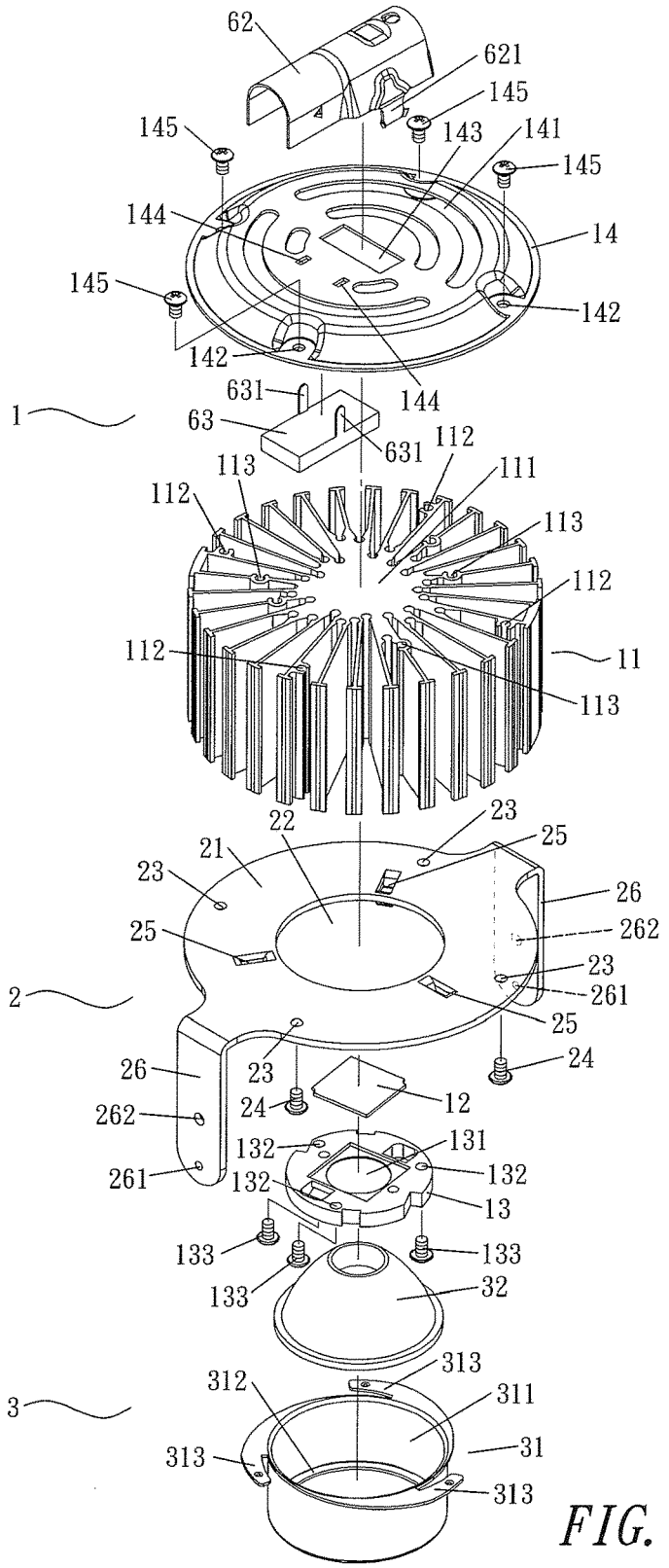
FIG. 3 is a partial exploded view of an embodiment of the present invention.

With reference to FIGS. 1-5 for a downlight 10 of an embodiment of the present invention, the downlight 10 is bidirectional rotating LED downlight comprising a light source device 1, a swing frame 2, a light distribution mechanism 3, a rotating assembly 4, a housing assembly 5 and a power supply 6, wherein the light source device 1 as shown in FIGS. 2 and 3 comprises a heat sink 11, an LED light source 12, a support frame 13 and a cover 14, and the heat sink 11 has a plurality of fins arranged radially and outwardly from a central solid body 111, a plurality of external engaging hole columns 112 erected from positions proximate to the external periphery of the heat sink 11, and their top and bottom have engaging holes formed thereon, a plurality of internal engaging hole columns 113 erected from position proximate to the internal periphery of the heat sink 11 and their top and bottom have engaging holes formed thereon, and the heat sink 11 is in a shape including but not limited to a circular cylindrical shape, a substantially square column shape, or any other shape; the LED light source 12 projects an LED light downward; the support frame 13 has a large through hole 131 formed at the middle of the support frame 13, a small recession formed at the periphery of the support frame 13, and a plurality of through holes 132 formed around the small recession, and the LED light source 12 is supported by the small recessions of the support frame 13, and then a plurality of engaging members 133 (such as bolts) are passed through the through holes 132 of the support frame 13 and secured with engaging holes formed at the internal periphery of the heat sink 11 and reserved at the bottom of the engaging hole columns 113 respectively, so that the LED light source 12 stays exactly on the bottom of the solid body 111 in the middle of the heat sink 11, so that when the LED light source 12 is operated, heat is dissipated upwardly into the solid body 111, and then dissipated to the outside through the radially arranged fins; the cover 14 is a circular disc object having a plurality of arc ventilation slots 141, a plurality of engaging holes 142, a center latch hole 143 and two insert holes 144 reserved at the top of the cover 14, and a plurality of engaging members 145 (such as bolts) of the cover 14 are passed through the corresponding engaging holes 142 and coupled to the engaging holes at the top of the engaging hole column 112 reserved at the eternal periphery of the heat sink 11 to assemble the heat sink 11, the LED light source 12, the support frame 13 and the cover 14 into a light source device 1, and the LED light source 12 projects an LED light downwardly through the large through hole 131 at the middle of the support frame 13 without any hindrance.

Figure 5:
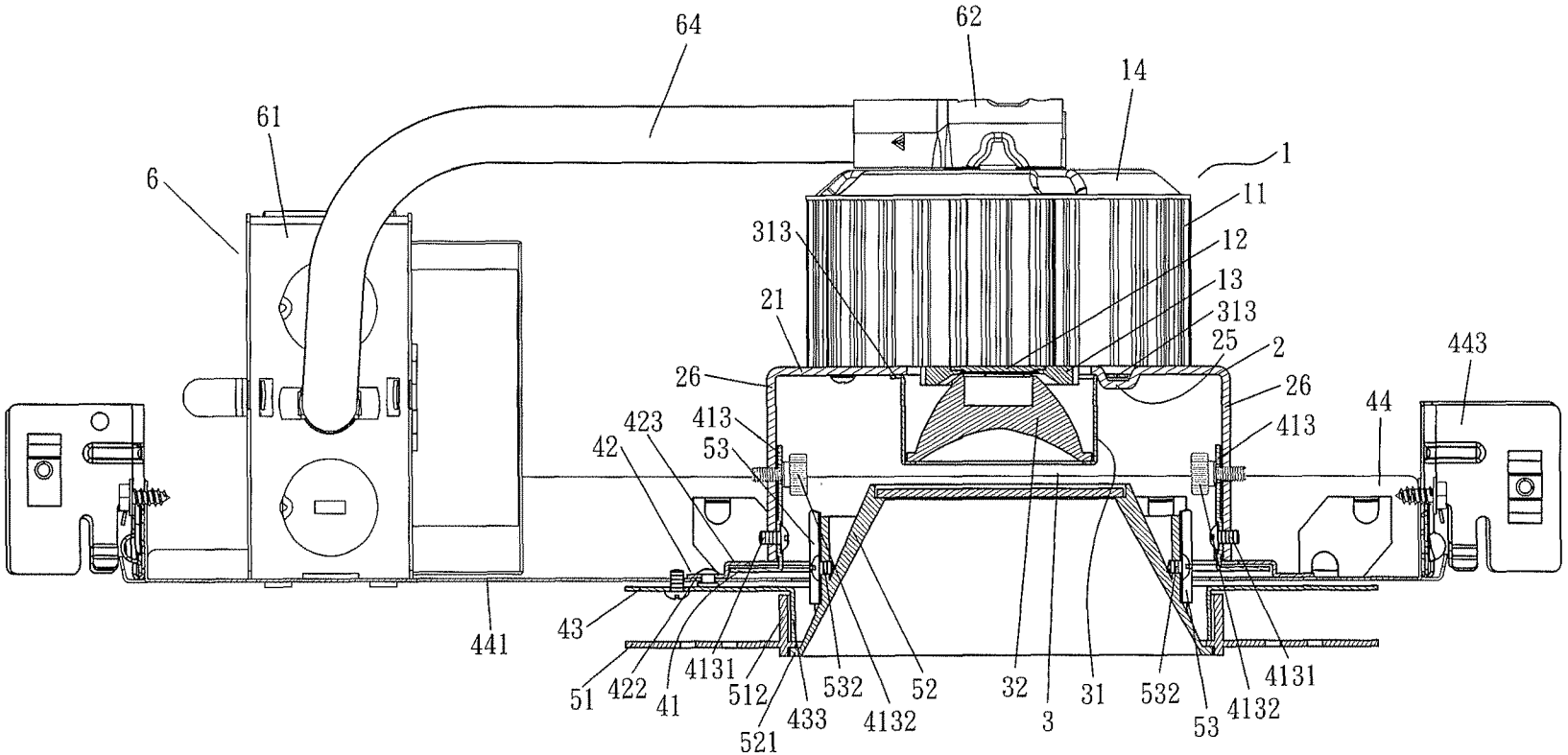
FIG. 5 is a cross-sectional view of an embodiment of the present invention.

The swing frame 2 has a flat portion 21, a center hole 22 formed at the middle of the flat portion 21, a plurality of through holes 23 formed at positions proximate to the external periphery and preferably at four corners for connection and provided for an engaging member 24 (such as a bolt) to pass through the engaging hole at the bottom of the engaging hole column 112 reserved at the external periphery of the heat sink 11 for locking and connection, so as to connect the flat portion 21 to the bottom of the heat sink 11, and the center hole 22 of the flat portion 21 is aligned precisely with the solid body 111 of the heat sink 11, and a plurality of latch slots 25 are formed and disposed around the center hole 22 formed at the bottom of the flat portion 21 (as shown in FIG. 5), and there are at least two latch slots 25 and preferably three latch slots 25, and both sides of the flat portion 21 have a small section extended outwardly and then vertically downward to form a connection plate 26, and the connection plate 26 has a fixing hole 261 and an adjusting hole 262 formed thereon.

The light distribution mechanism 3 comprises a fixed cylinder 31 and a light distribution member 32, and a containing space 311 is formed at both of the top and bottom of the fixed cylinder 31, and the bottom periphery has a shield wall 312, and the outer wall of the top of the fixed cylinder 31 is extended outwardly and upwardly with a small angle to form a plurality of buckles 313, and the quantity of buckles 313 is equal to the quantity of latch slots 25 of the swing frame 2, and there are at least two latch slots 25 and preferable three latch slots 25, and the light distribution member 32 may be a lens or a reflective cup as needed, and the lens or reflective cup is a light distribution member 32, and users may change the light distribution member 32 (either the lens or the reflective cup) according to the requirements of the illuminating object or illuminating environment to adjust the angle of diffusion for projecting the light; during assembling, the light distribution member 32 is accommodated in the containing space 311 of the fixed cylinder 31, and the bottom edge of the light distribution member 32 abuts the shield wall 312, and then the buckles 313 of the fixed cylinder 31 are passed through the latch slots 25 of the swing frame 2 respectively, and the fixed cylinder 31 is rotated, so that the buckles 313 and the corresponding latch slots 25 are latched securely with each other to define the status of covering the light distribution member 32 by the fixed cylinder 31 and latching the bottom of the flat portion 21 of the swing frame 2 (as shown in FIG. 5).

Figure 4:
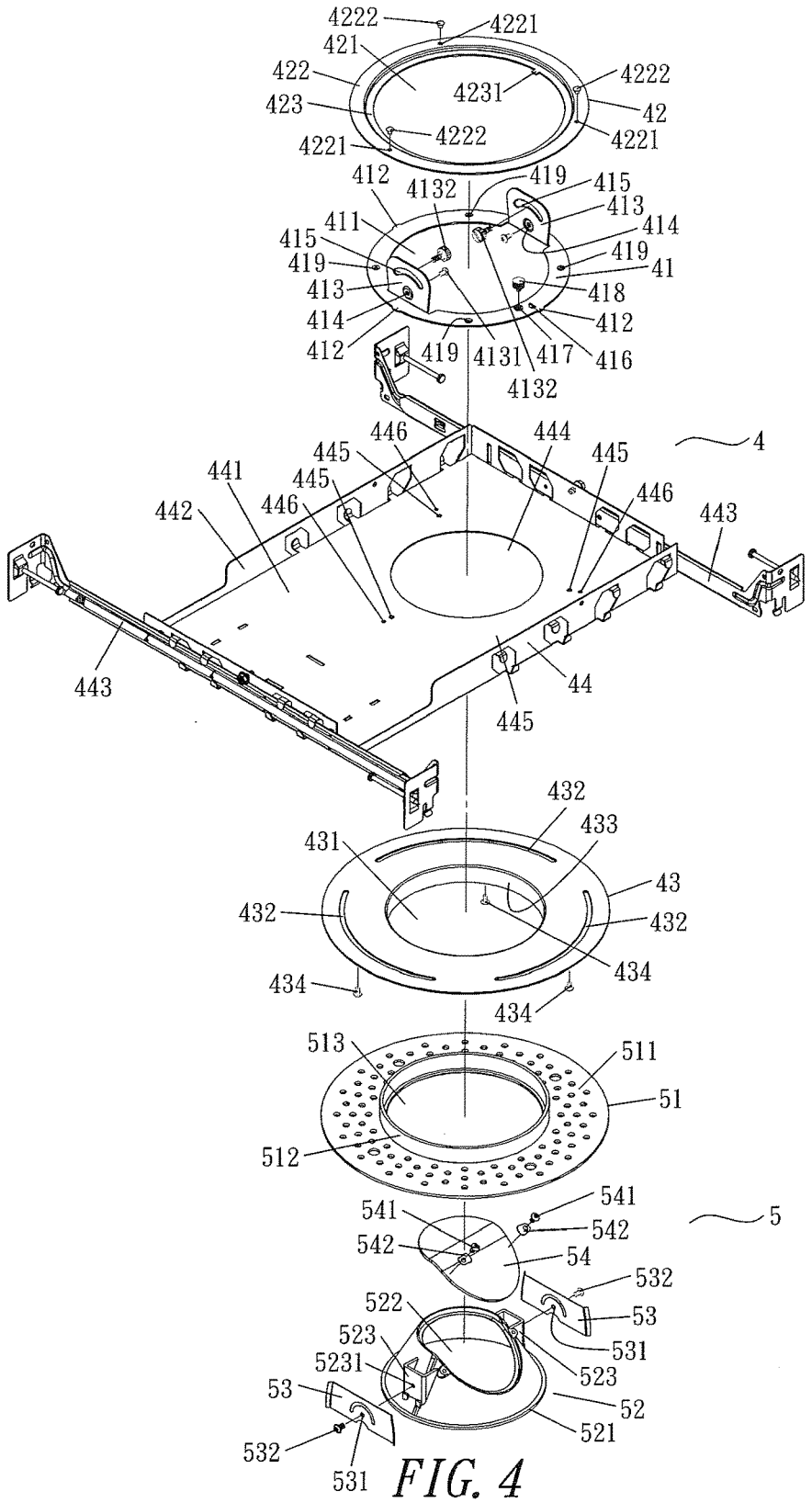
FIG. 4 is another partial exploded view of an embodiment of the present invention.

In FIGS. 2 and 4, the rotating assembly 4 comprises an upper rotating ring 41, an upper fixed ring 42 and a lower rotating ring 43, and the upper rotating ring 41 is a ring with a large through hole 411 formed at the center of the ring, and at least three outer flanges 412 (such as four flanges uniformly disposed and protruded from the upper rotating ring 42) protruded from the external periphery of the ring body, and a connection plate 413 erected upwardly and symmetrically from both sides of the internal periphery of the large through hole 411, and the connection plate 413 has a fixing hole 414 and an adjusting arc slot 415, and a sidewall of the upper rotating ring 41 has a positioning bump 416 and a screw hole 417 formed thereon and provided for screwing a packing member 418, and at least three lower flanges 419 (such as four flange uniformly disposed and protruded from the bottom edge) are protruded downwardly from the bottom edge; the upper fixed ring 42 is a ring with a large through hole 421 formed at the center, and the ring body is divided into an outer peripheral wall 422 and an inner peripheral wall 423 for the purpose of fixing, and the inner peripheral wall 423 is taller than the outer peripheral wall 422, and the height difference between the inner peripheral wall 423 and the outer peripheral wall 422 is provided for receiving the ring body (including the outer flange 412) of the upper rotating ring 41, and the outer peripheral wall 422 has a plurality of engaging holes 4221 (such as four engaging holes 4221) formed thereon, and a limit bump 4231 is formed at the internal periphery of the inner peripheral wall 423; the lower rotating ring 43 has a large through hole 431 formed at the center of the lower rotating ring 43, and the ring body has three arc stripe slots 432 formed uniformly around the ring body, and the internal periphery of the large through hole 431 has a vertical wall 433 extended vertically downward; the rotating assembly 4 is operated together with a stand mechanism 44, and the stand mechanism 44 combines a board 441 with the standing wall 442 into the form of a square frame, and a group of symmetrical standing walls 442 are combined with male and female slippers 443, so as to stretch to a predetermined length and fix the whole stand mechanism 44 to a high position of a building, and the stand mechanism 44 has a large mounting hole 444 formed on the board 441, and a group of first engaging holes 445 and a group of second engaging holes 446 formed around the periphery of the large mounting hole 444, wherein the quantity and position of the first engaging holes 445 are equal to those of the engaging holes 4221 of the upper fixed ring 42, and the quantity and diameter of the first engaging holes 446 are equal to those of the arc stripe slots 432 of the lower rotating ring 43; during assembly, the upper rotating ring 41 is placed on the board 44 of the stand mechanism 44 and standing on the board 441 from the lower flange 419 at the bottom edge of the upper rotating ring 41, while the large through hole 411 of the upper rotating ring 41 is aligned precisely with the large mounting hole 444 of the board 441, and then the upper fixed ring 42 is disposed at the outer periphery of the inner peripheral wall 423 and aligned precisely with and covered onto the external periphery of a ring body (including the outer flange 412) the upper rotating ring 41, such that the outer peripheral wall 422 of the upper fixed ring 42 covers the board 441, and the engaging holes 4221 of the outer peripheral wall 422 are aligned precisely with the first engaging holes 445 of the board 441 respectively, and an engaging member 4222 (such as a rivet) is passed from top to bottom through the engaging hole 4221 and then coupled (or riveted) to the first engaging hole 445 of the board 441, and then the packing member 418 is secured to press the upper rotating ring 41 downward, so that the upper rotating ring 41 will not be rotated freely; and then the lower rotating ring 43 is attached to the bottom of the board 441, and the large through hole 431 of the lower rotating ring 43 is aligned precisely with the large mounting hole 444 of the board 441, while the arc stripe slots 432 of the lower rotating ring 43 are aligned precisely with the second engaging holes 446 of the board 441, and then an engaging member 434 (such as a screw) is passed from bottom to top through the arc stripe slot 432 of the lower rotating ring 43 and coupled (riveted) to the second engaging hole 446 of the board 441; so that the upper rotating ring 41 and the upper fixed ring 42 achieve a first effect of assembling and connecting the upper rotating ring 41 to the stand mechanism 44 from the top, and a second effect of assembling the lower rotating ring 43 to the stand mechanism 44 from the bottom.

Figure 6:
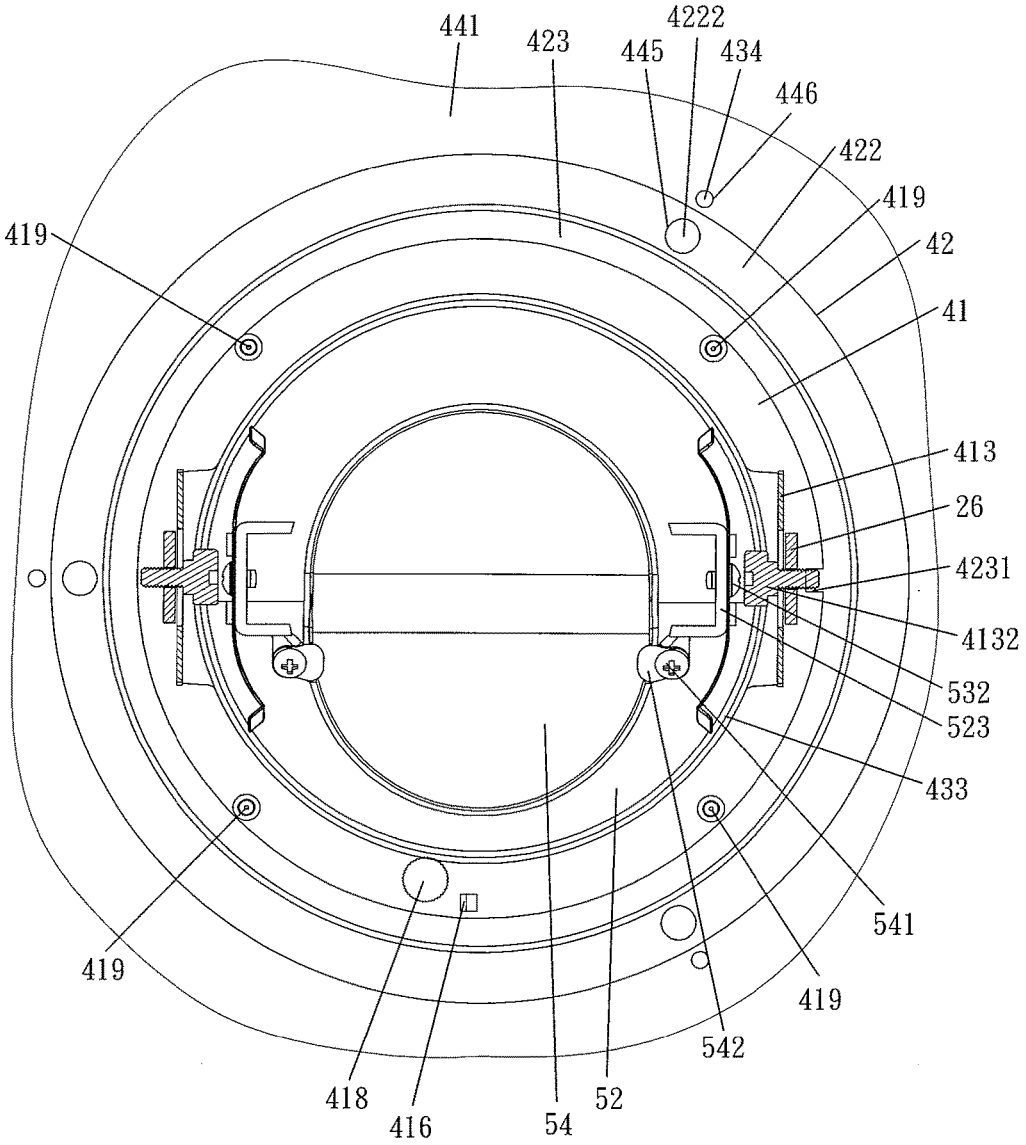
FIG. 6 is a top view of a combination of a rotating assembly and a housing assembly in accordance with an embodiment of the present invention.
Figure 7:
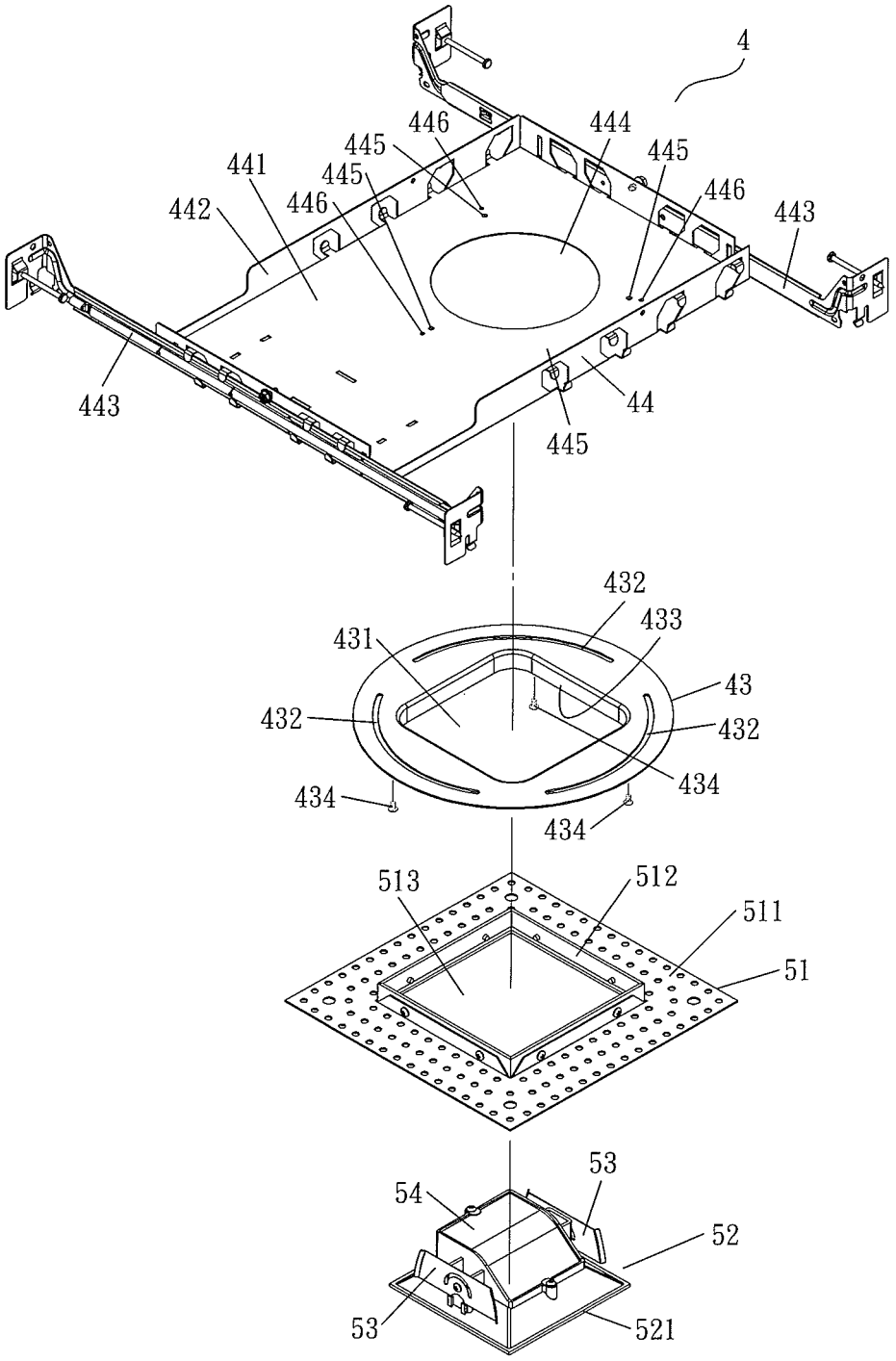
FIG. 7 is an exploded view of a lower rotating ring and a square housing assembly in accordance with an embodiment of the present invention.

The housing assembly 5 comprises a decorative ring 51, a reflector 52 and an elastic plate 53, and the decorative ring 51 has a planar circular disc 511 with the middle erected to form a standing wall 512, and the interior being a vertically penetrating large through hole 513; the reflector 52 is a tapered conical object, and a wall bracket 521 is formed at the bottom edge of the outer surface and a vertically penetrating conical light output hole 522 is formed at the middle, and the outer surface has two symmetrical and vertical engaging walls 523, and the engaging wall 523 has an engaging hole 5231; the light output hole 522 includes an oblique side hole formed on a side of the light output hole 522, in addition to the top portion, and the top of the reflector 52 may or may not install a glass plate 54, and if the glass plate 54 is installed, the glass plate 54 must have a size equal to or slightly larger than the light output hole 522, so that the glass plate 54 can be placed onto the light output hole 522 of the reflector 52, and then a group of locking members 541 (such as bolts) are passed through a group of pressing plates 542 respectively and locked to a side edge of the sidewall where the engaging wall 523 and the reflector 52 are connected, so that the group of pressing plates 542 are provided for pressing the glass plate 54 and the reflector 52 for the purpose of connection and positioning (as shown in FIG. 6); the elastic plate 53 comes with a specific length and a quantity (at least two) which is equal to the engaging wall 523, and the elastic plate 53 has a through hole 531, and the elastic plate 53 is attached onto the engaging wall 523, and then an engaging member 532 (such as a bolt) is passed through the through hole 531 and secured to the engaging hole 5231 of the engaging wall 523, so as to secure the elastic plate 53 onto the corresponding engaging wall 523; during assembling, the reflector 52 is received from bottom to top from the large through hole 513 of the decorative ring 51, until the wall bracket 521 of the reflector 52 upwardly supports the bottom edge of the standing wall 512 of the decorative ring 51, and then the reflector 52 is received from bottom to top through the large through hole 431 of the lower rotating ring 43, and during the process, the vertical wall 433 of the lower rotating ring 43 is inserted into a range of the standing wall 512 of the decorative ring 51 and attached to the standing wall 512 (as shown in FIG. 5), while two side edges of the elastic plate 53 are pressed and bent inwardly with an appropriate deformation to abut the inner wall surface of the vertical wall 433 of the lower rotating ring 43 (as shown in FIGS. 5 and 6), and in other words, the housing assembly 5 and the lower rotating ring 43 of the rotating assembly 4 achieve the assembling and connecting effects by bending and pressing both side edges of the elastic plate 53. In the figures, it is noteworthy that the form of the large through hole 431 and vertical wall 433 of the lower rotating ring 43 and the form of the decorative ring 51 and the bottom of the reflector 52 are in a circular shape, but the invention is not limited to the circular shape only, and it can be of any shape. In FIG. 7, the large through hole 431 and the vertical wall 433 of the lower rotating ring 43 may be designed into a substantially square shape, so that the decorative ring 51 and the bottom of the reflector 52 are also changed into square shape. In other words, the circular disc 511, standing wall 512 and large through hole 513 of the decorative ring 51 and the wall bracket 521, light output hole 522 and glass plate 54 of the reflector 52 are changed into a square shape, and the advantage of changing these components into square shape resides on that an edge of the circular disc 511 (which is the edge of the downlight) is aligned in the same direction with a wall of a building to improve the aesthetic appearance. Since there are various stylish looks, they will not be described in details here. The scope of the present invention is intended to cover any change of shapes.

The power supply 6 comprises a box body 61, a connector cover 62, a thermostat 63 and a connecting wire 64, and the box body 61 is installed onto the board 441 of the stand mechanism 44, and provided for receiving power supplied from the mains for the work of stabilizing the voltage and rectifying the current. The connector cover 62 is substantially in a semicircular arc, and the bottom of the connector cover 62 extends a group of latch pins 621 for latching and positioning the latch hole 143 at the middle of the cover 14. The thermostat 63 extends a group of connection plates 631 upward and further extends from bottom to top into the insert hole 144 of the cover 14, and the extended portion is turned and bent, so that the thermostat 63 is suspended in a space under the cover 14. The connecting wire 64 leads the power source from the box body 61 to the connector cover 62, and then electrically connects the thermostat 63 and the LED light source 12.

With reference to FIGS. 1 and 5 for the assembling of the downlight 10 of the present invention, the heat sink 11, the LED light source 12, the support frame 13 and the cover 14 are assembled into a light source device 1, while the flat portion 21 of the swing frame 2 is coupled to the bottom of the heat sink 11, so that the LED light source 12 stays in the center hole 22 at the center of the top of the swing frame 2, and then the light distribution mechanism 3 is latched to the bottom of the flat portion 21 of the swing frame 2, and then the connection plates 26 on both sides of the swing frame 2 are disposed on the outer side of the connection plate 413 of the upper rotating ring 41 of the rotating assembly 4, and then an engaging member 4131 (such as a bolt) is passed from inside to outside through the fixing hole 414 of the connection plate 413 and then pivotally coupled to the fixing hole 261 of the connection plate 26, and an adjusting screw 4132 is passed through and secured to the adjusting arc slot 415 of the connection plate 413 and the adjusting hole 262 of the connection plate 26, so that the swing frame 2 and the upper rotating ring 41 of the rotating assembly 4 are assembled. Since the rotating assembly 4, the housing assembly 5, and the power supply 6 have been assembled according to the aforementioned assembling relation, the assembling of the whole downlight 10 is completed.

Figure 8:
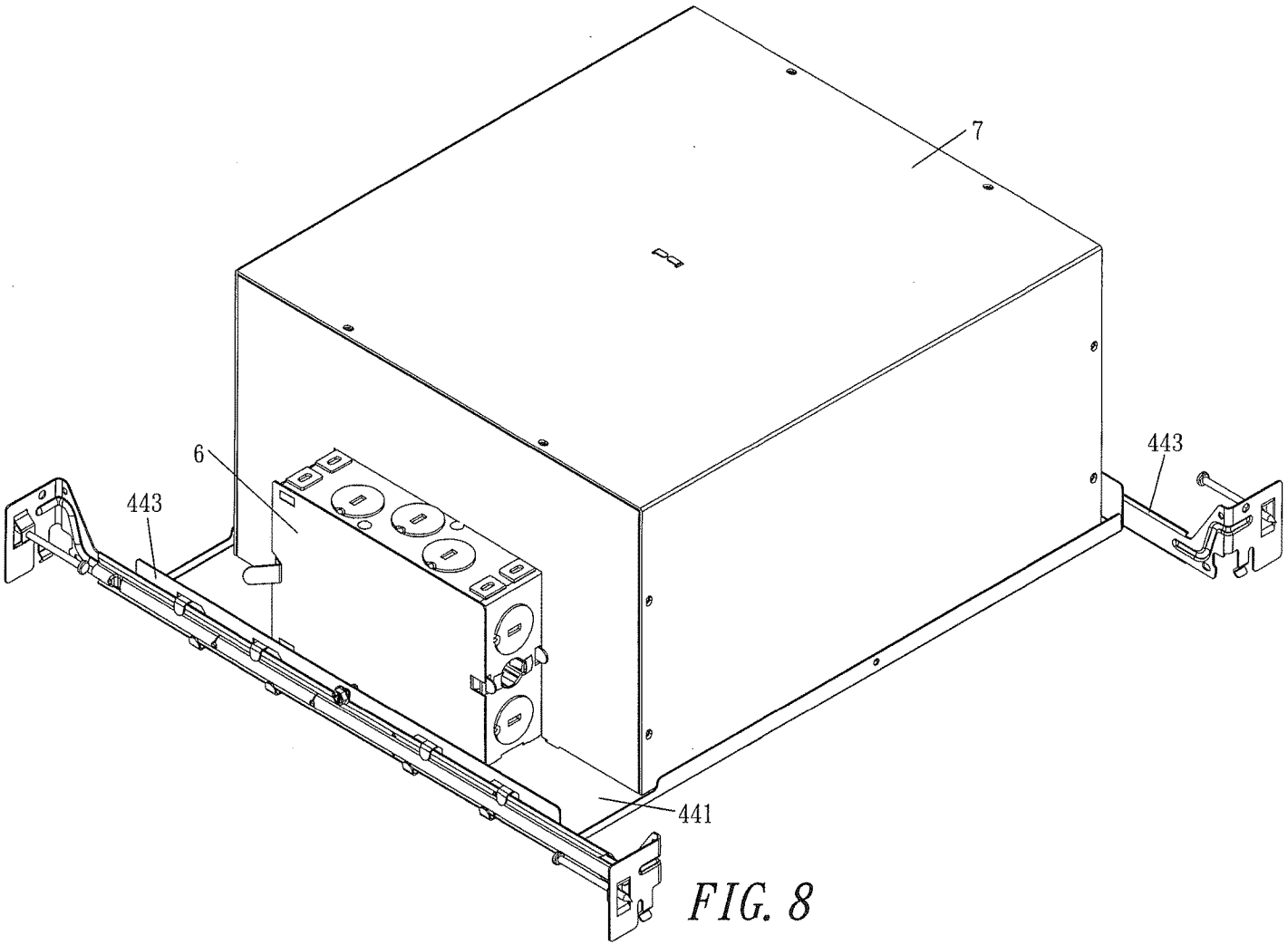
FIG. 8 is a perspective view of an embodiment of the present invention covered with an isolating housing.
Figure 9:
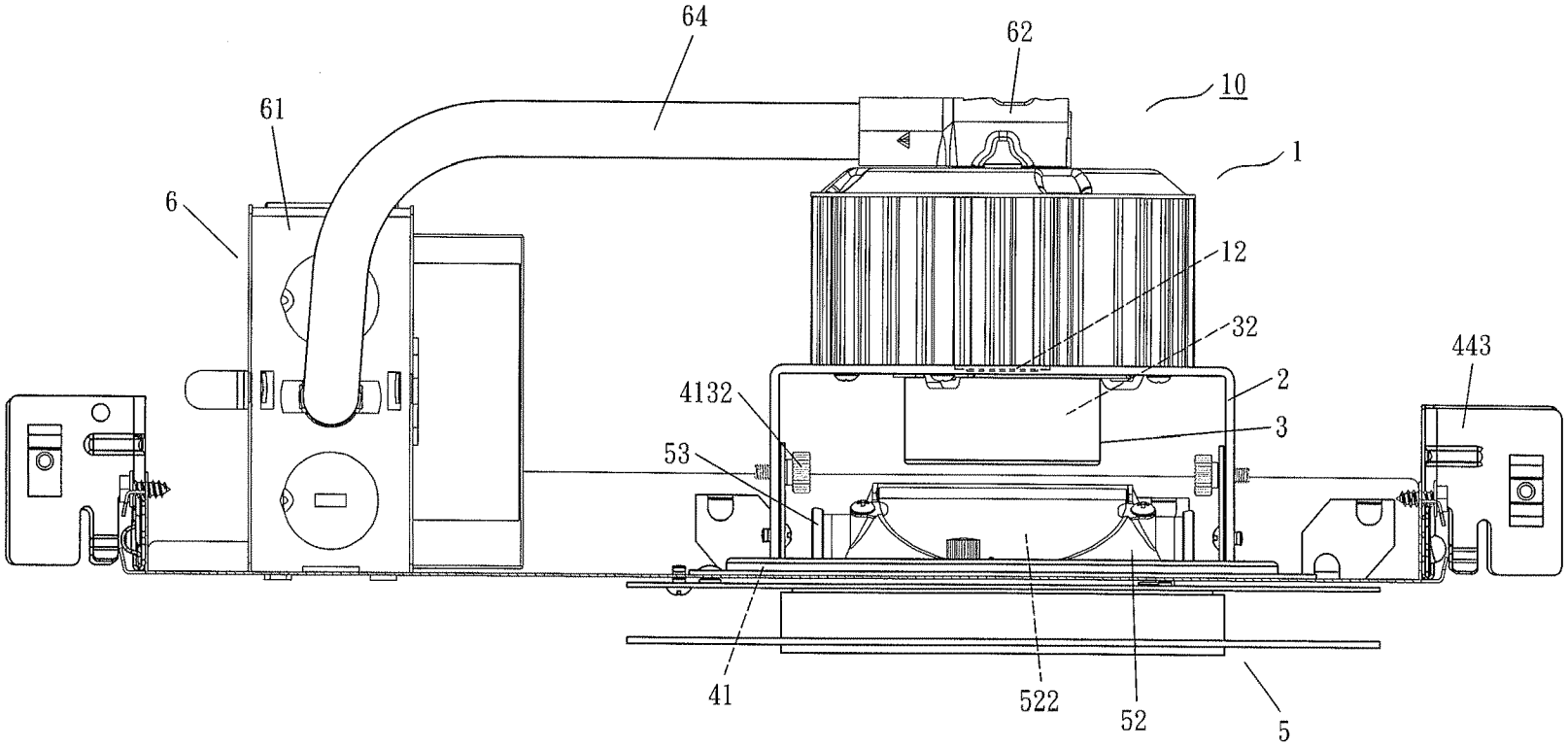
FIG. 9 is a front view showing a first using status of an embodiment of the present invention.
Figure 10:
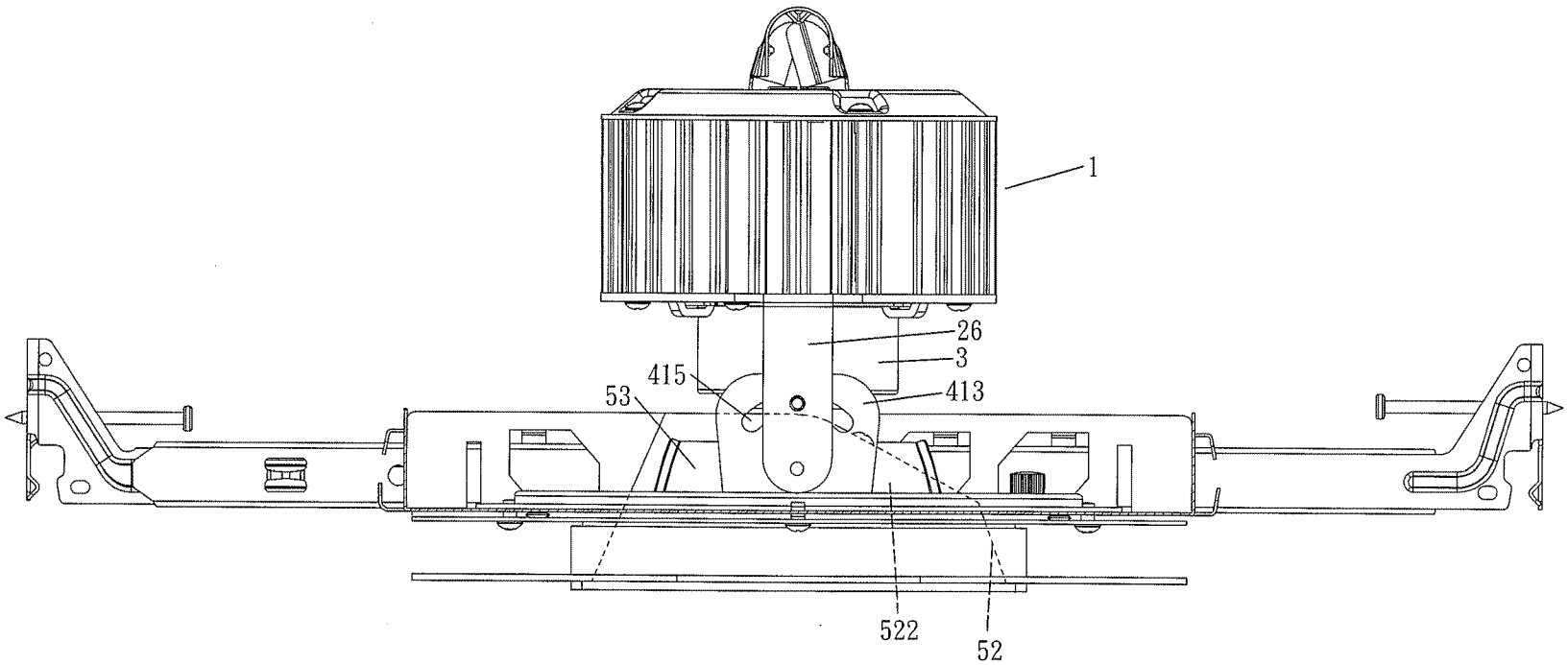
FIG. 10 is a side view showing the first using status of an embodiment of the present invention.

To achieve the fire prevention effect of a building, fireproof cotton is installed at different positions, but the heat sink 11 of the downlight 10 as shown in FIGS. 1 and 5 has no cover onto the top of the heat sink 11, so that the fireproof cotton is not touched. In FIG. 8, an isolating housing 7 is covered onto the board 441 of the stand mechanism 44, so that the portion of the downlight 10 disposed on the board 441 is covered, and the isolating housing 7 can touch the fireproof cotton to gain the fire protection effect. In the use of the downlight 10 in accordance with an embodiment of the present invention, the situation of whether or not the swing frame 2 is rotated with a deviated angle on the vertical plane or whether or not the upper rotating ring and the lower rotating ring 43 are rotated with angle on the horizontal plane determines the following using statuses:

1. In FIGS. 1, 9, and 10, when the swing frame 2 has no deviated rotation on the vertical plane (but maintains a vertical state), and the upper rotating ring 41 has no rotation on the horizontal plane, the LED light source 12 projects a light downward, and then the light distribution member 32 (regardless of the lens or reflective cup) of the light distribution mechanism 3, the light range will be expanded broader, and then when the light distribution member 32 is passed downwardly through the reflector 52 of the housing assembly 5, the light range is expanded further, so that a large quantity of bright light can be passed through the light output hole 522 and projected to the space below.

Figure 11:
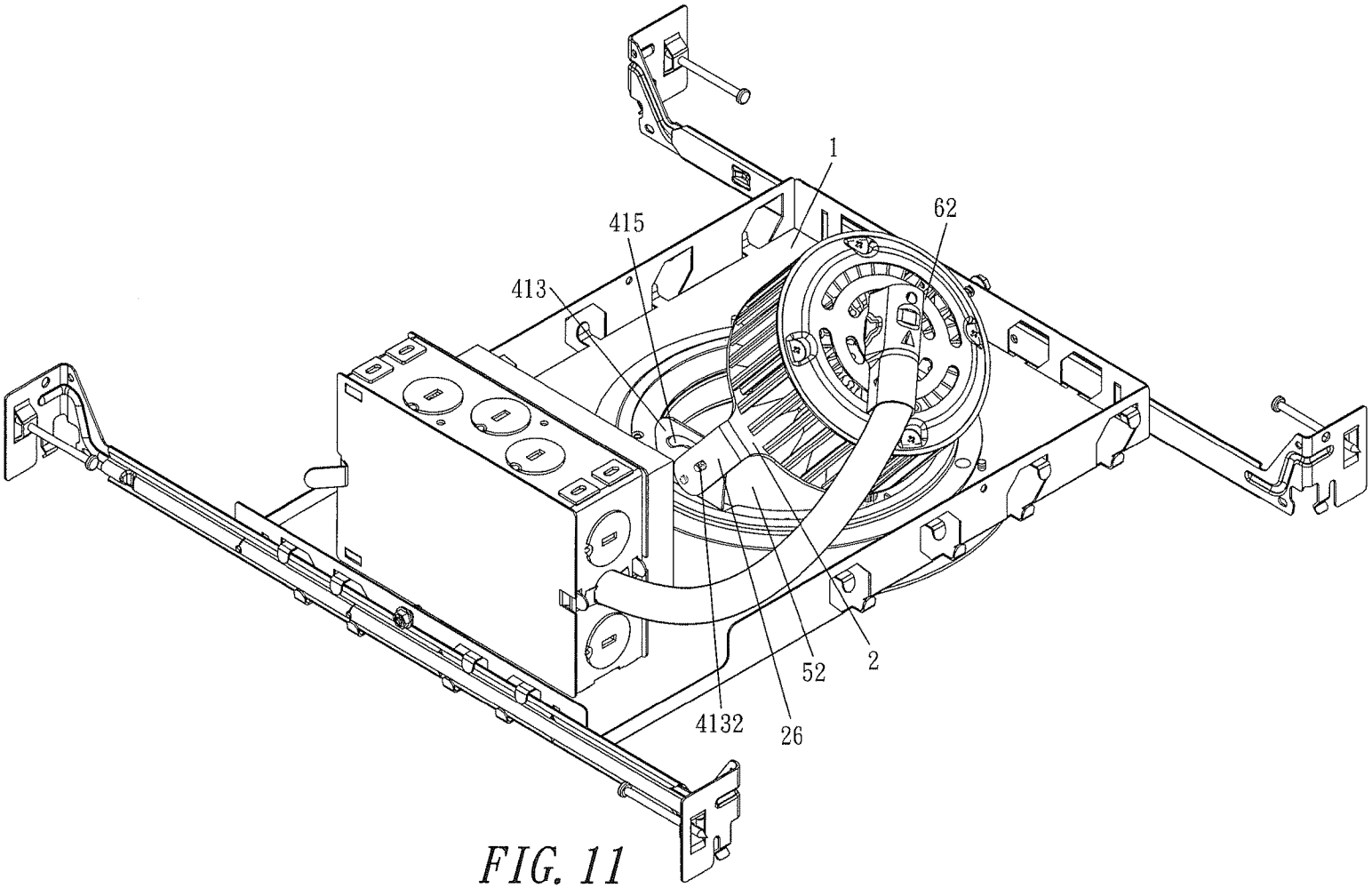
FIG. 11 is a perspective view showing a second using status of an embodiment of the present invention.
Figure 12:
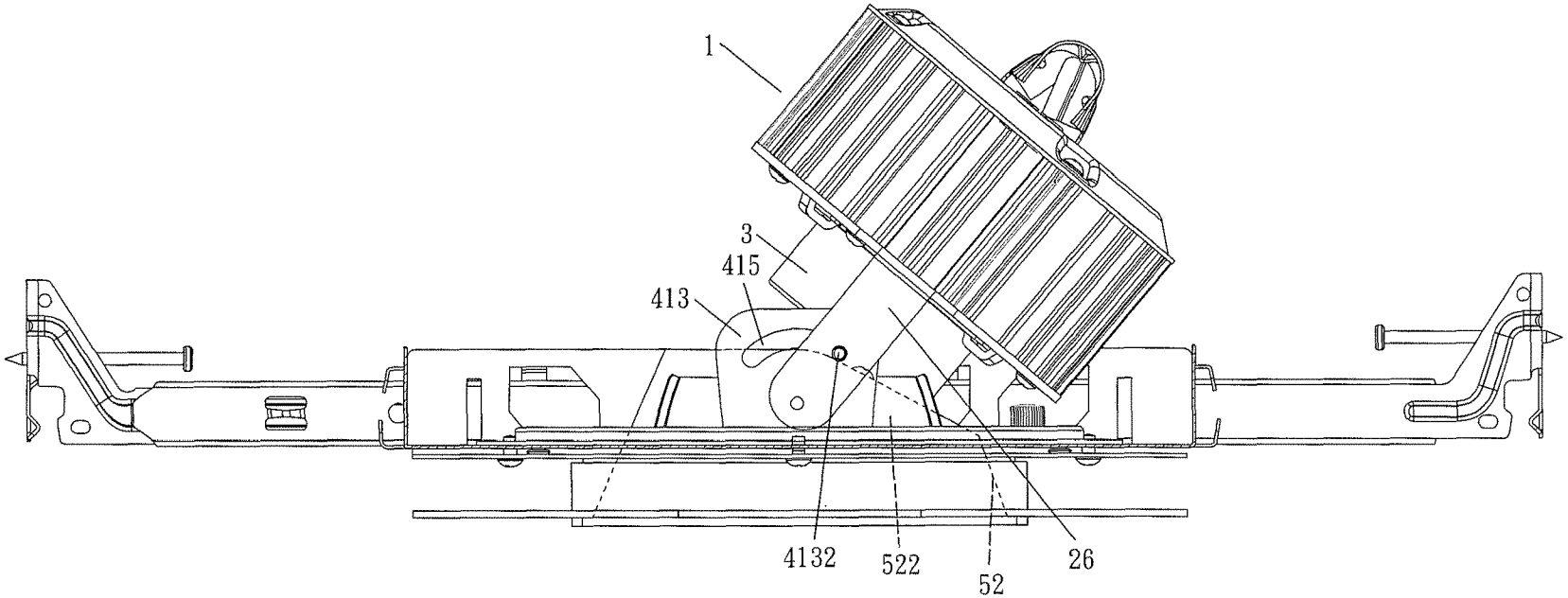
FIG. 12 is a side view showing the second using status of an embodiment of the present invention.

2. In FIGS. 11 and 12, the swing frame 2 may be deviated and rotated for a certain angle from its original vertical state towards any one of the sides, and the adjusting screws 4132 on both side is loosened and released from the locking of the adjusting arc slot 415 of the connection plate 413, and then the engaging member 4131 may be uses as an axis for turning the swing frame 2 together with the light source device 1 and the light distribution mechanism 3 to rotate with a specific deviated angle, and then the adjusting screws 4132 on both sides are screwed securely to lock the adjusting arc slot 415 of the connection plate 413 again. The swing frame 2 is turned to a selected side (generally the side towards the side hole of the light output hole 522 of the reflector 52) and rotated with a specific deviated angle, and then the direction of the light projected from the LED light source 12 will be changed from the original vertical state to an oblique side. In other words, the light projection direction is opposite to the deviation angle of the swing frame 2 are opposite to each other. Since the light output hole 522 of the reflector 52 includes a top portion and a side hole tilted towards a side, therefore after the swing frame 2 is rotated and deviated, the light output hole 522 (including the side hole) of the reflector 52 is sufficient to allow the projected light to pass through completely without any hindrance.

Figure 13:
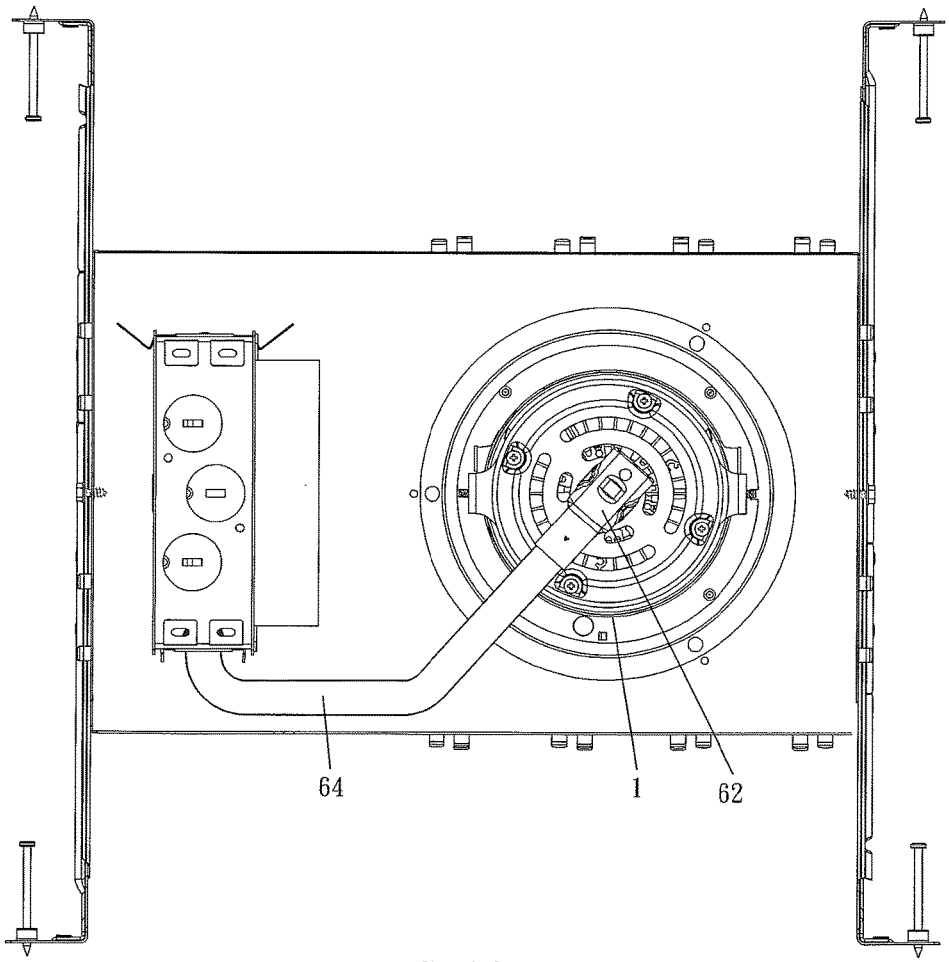
FIG. 13 is a top view showing a third using status of an embodiment of the present invention.

3. In FIG. 13, when the swing frame 2 has no deviated rotation on the vertical plane (but maintains its vertical state), the upper rotating ring 41 together with the swing frame 2 may be rotated for a specific angle on the horizontal plane. Since the ring body of the upper rotating ring 41 (including the outer flange 412) is covered by the inner peripheral wall 423 of the upper fixed ring 42, and the upper fixed ring 42 is secured by the engaging member 4222, therefore the upper rotating ring 41 may be rotated within the range of the inner peripheral wall 423 without the risk of being separated. During operation, it is necessary to loosen and release the latching effect of the packing member 418 from the upper rotating ring 41 and apply a force to push the swing frame 2 and link the upper rotating ring 41 to rotate synchronously. When the upper rotating ring 41 is rotated to a position, the packing member 418 is locked again to abut the upper rotating ring 41. During the process, the existence of the outer flange 412 and the lower flange 419 may reduce the friction between the upper fixed ring 42 and the board 441 when the upper rotating ring 41 is rotated. In the meantime, the positioning bump 416 of the upper rotating ring 41 is limited by the limit bump 4231 of the inner peripheral wall 423, so that the upper rotating ring 41 can only be rotated in one direction and then rotated in the opposite direction, and the rotation angle cannot exceed 360°, and the design preferably has a rotation angle of 0~355°.

Figure 14:
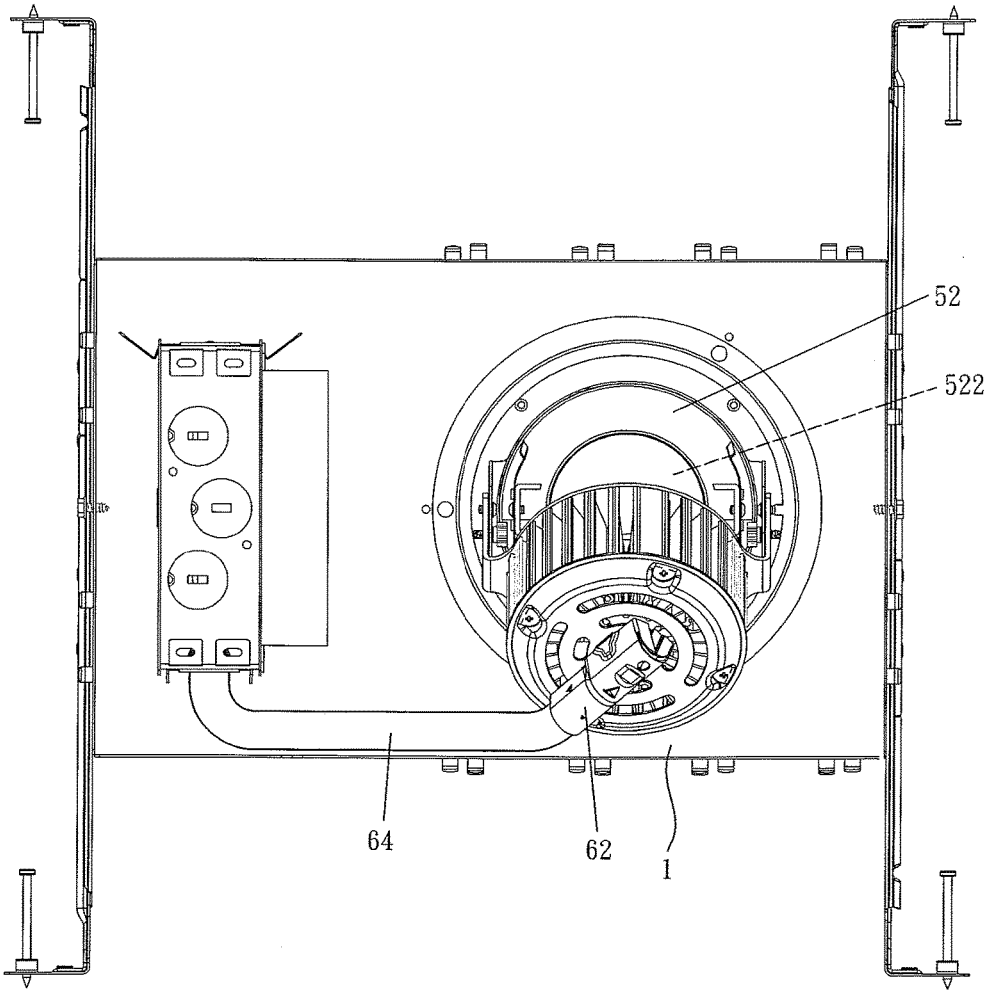
FIG. 14 is a top view showing a fourth using status of an embodiment of the present invention.

4. In FIG. 13, the upper rotating ring 41 and the swing frame 2 are rotated within a specific angle on the horizontal plane. In FIG. 14, the swing frame 2 is rotated for a specific angle from its original vertical state to a side, so that the projection direction of the LED light can be adjusted by the horizontal and vertical rotations according to the using requirements.

5. Since the lower rotating ring 43 is attached to the bottom of the board 441, and the engaging member 434 is passed through the arc stripe slot 432 and coupled to the second engaging hole 446 of the board 441, therefore the engaging member 434 can be used as a limiting point for rotating the lower rotating ring 43, and the rotation angle has a range equal to the range of the angle of the arc stripe slot 432. When the lower rotating ring 43 is rotated, the reflector 52 and the decorative ring 51 are rotated accordingly, so that if the decorative ring 51 is in a square shape, the edge of the circular disc 511 of the decorative ring 51 can be adjusted by rotation to align its direction with the direction of the wall of the building, so as to improve the aesthetic appearance.

In summation of the description above, the downlight 10 of present invention can be assembled conveniently, and the bidirectional rotating for horizontal rotation and vertical swing allows users to select and adjust the light projection direction and angle, so as to improve the practicality of the LED downlight for illumination.

While the invention has been described by means of specific embodiments, numerous modifications and variations could be made thereto by those skilled in the art without departing from the scope and spirit of the invention set forth in the claims.

What is claimed is:

1. A bidirectional rotating LED downlight, comprising a light source device, a swing frame, a light distribution mechanism, a rotating assembly, a housing assembly and a power supply, characterized in that:

the light source device comprises a heat sink, an LED light source, a support frame and a cover, and the heat sink has a plurality of fins arranged radially from the middle of a solid body of the heat sink; the LED light source is supported by the support frame and coupled to the bottom of the heat sink, and a large through hole is formed in the middle of the support frame provided for the LED light source to project an LED light downward; the cover is coupled to the top of the heat sink;

the swing frame has a flat portion, a center hole formed in the middle of the flat portion, and the flat portion is coupled to the bottom of the heat sink, so that the center hole is aligned precisely with the solid body of the heat sink, and at least two latch slots are formed at the boom of the flat portion and disposed around the center hole, and a small section is extended separately and outwardly from both sides of the flat portion and then vertically downward to form a connection plate, and a fixing hole and an adjusting hole are formed and penetrated through the connection plate;

the light distribution mechanism comprises a fixed cylinder and a light distribution member, and an inwardly hollow containing space is formed at both of the top and bottom of the fixed cylinder separately, a shield wall is reserved at the periphery of the bottom of the containing space, and at least two buckles disposed and extended outwardly from the outer wall of the top of the fixed cylinder, and the light distribution member is contained in the containing space of the fixed cylinder, and has a bottom periphery abutting the shield wall, and the buckles of the fixed cylinder are passed through the latch slots of the swing frame respectively for latching;

the rotating assembly comprises an upper rotating ring, an upper fixed ring and a lower rotating ring, and the upper rotating ring has a large through hole formed at the middle of the upper rotating ring, and the ring body has a connection plate symmetrically erected from both sides of the internal periphery of the connection plate, and the connection plate has a fixing hole and an adjusting arc slot; the middle of the upper fixed ring is a large through hole, and the ring body is further divided into an outer peripheral wall and an inner peripheral wall, and the inner peripheral wall is taller than the outer peripheral wall; the lower rotating ring has a large through hole formed at the middle of the lower rotating ring, and the ring body has three arc stripe slots formed and distributed uniformly on the ring body, and the large through hole has a vertical wall extended downwardly and vertically from the internal periphery of the large through hole; the rotating assembly is operated with a stand mechanism, and the stand mechanism has a board, and the board has a large mounting hole formed thereon; during assembling, the upper rotating ring is installed onto the board of the stand mechanism, and the large through hole of the upper rotating ring is aligned precisely with the large mounting hole of the board, and then the inner peripheral wall of the upper fixed ring is coupled and covered onto the upper rotating ring, and the outer peripheral wall of the upper fixed ring is covered onto the board, and then an engaging member is passed through the outer peripheral wall of the upper fixed ring and coupled to the board; meanwhile, the lower rotating ring is attached onto the bottom of the board, and the large through hole of the lower rotating ring is aligned precisely with the large mounting hole of the board, and then an engaging member is passed through the arc stripe slot of the lower rotating ring and coupled to the board, and the connection plates on both sides of the swing frame are disposed on the outer side of the connection plate of the upper rotating ring, and an engaging member is passed through the fixed hole on the connection plate of the upper rotating ring and pivotally coupled to the fixing hole of the connection plate of the swing frame, and an adjusting screw is passed through the adjusting arc slot of the connection plate of the upper rotating ring and locked securely with the adjusting hole of the connection plate of the swing frame;

the housing assembly comprises a decorative ring, a reflector and an elastic plate, and the decorative ring has a planar circular disc, with the middle erected upwardly to form a standing wall, and the interior being penetrated to form a large through hole; the reflector has a wall bracket formed at the bottom edge of the outer surface of the reflector, and the middle being penetrated to form a light output hole, and outer surface of the reflector has at least two engaging walls; the elastic plate with a length is locked onto the engaging wall; the reflector is accommodated in the large through hole of the decorative ring, so that the wall bracket supports the bottom edge of the standing wall of the decorative ring, and then the reflector is received from the large through hole of the lower rotating ring, and the vertical wall of the lower rotating ring is inserted into a range of the standing wall of the decorative ring during the process, while both side edges of the elastic plate are bent inwardly to abut the inner wall surface of the vertical wall of the lower rotating ring; and the power supply comprises a box body, a connector cover, a thermostat and a connecting wire, and the box body receives power supplied from the mains to stabilize and rectify a circuit compilation work, and the connector cover is substantially a semicircular arc and latched onto the cover, and the thermostat is suspended in the space under the cover, and the connecting wire leads the power source in the box body to the connector cover and connects the thermostat and the LED light source downwardly to achieve an electrical connection.

2. The bidirectional rotating LED downlight of claim 1, wherein the light distribution member is a lens or a reflective cup.

3. The bidirectional rotating LED downlight of claim 1, wherein the reflector has a glass plate installed to the top of the reflector and disposed onto the light output hole of the reflector, and a group of locking members are passed through a group of pressing plates and locked to an edge of a sidewall where the engaging wall and the reflector are coupled in order to press the glass plate and the reflector for connection and positioning.

4. The bidirectional rotating LED downlight of claim 1, wherein the decorative ring and the reflector may be of any shape.

5. The bidirectional rotating LED downlight of claim 1, wherein the upper rotating ring has at least three outer flanges protruded from the external periphery of a ring body of the upper rotating ring and provided for reducing the friction with the upper fixed ring when the upper rotating ring is rotated.

6. The bidirectional rotating LED downlight of claim 1, wherein the upper rotating ring has at least three lower flanges protruded downwardly from the bottom edge of a sidewall of the upper rotating ring and provided for reducing the friction with the board when the upper rotating ring is rotated.

7. The bidirectional rotating LED downlight of claim 1, wherein the upper rotating ring has a positioning bump formed on a sidewall of the upper rotating ring, and the upper fixed ring has a limit bump formed at the internal periphery of an inner peripheral wall of the upper fixed ring; so that when the upper rotating ring is rotated, the positioning bump is limited by the limit bump, and the upper rotating ring can only rotate in one direction and then rotate in the opposite direction.

8. The bidirectional rotating LED downlight of claim 1, wherein the upper rotating ring has a packing member screwed onto a sidewall of the upper rotating ring and provided for positioning the upper rotating ring by a packing effect.

9. The bidirectional rotating LED downlight of claim 1, wherein the reflector is a tapered conical object with a conical light output hole formed and vertically penetrating through the reflector.

10. The bidirectional rotating LED downlight of claim 1, wherein the light output hole further has an oblique side hole formed on a side of the light output hole, in addition to the top portion.

11. The bidirectional rotating LED downlight of claim 10, wherein the light output hole further has an oblique side hole formed on a side of the light output hole, in addition to the top portion.

* * * * *